US012442173B2

(12) United States Patent
Najjar et al.

(10) Patent No.: US 12,442,173 B2
(45) Date of Patent: Oct. 14, 2025

(54) RETROFIT PORTABLE BIDET ASSEMBLY

(71) Applicant: Travel Bidet, Inc., Concord, NC (US)

(72) Inventors: Sami Sakib Najjar, Concord, NC (US); George B. Waites, Jr., Fletcher, NC (US)

(73) Assignee: Travel Bidet, Inc., Concord, NC (US)

( * ) Notice: Subject to any disclaimer, the term of this patent is extended or adjusted under 35 U.S.C. 154(b) by 0 days.

(21) Appl. No.: 18/280,596

(22) PCT Filed: Aug. 3, 2023

(86) PCT No.: PCT/US2023/029421
§ 371 (c)(1),
(2) Date: Sep. 6, 2023

(87) PCT Pub. No.: WO2024/030564
PCT Pub. Date: Feb. 8, 2024

(65) Prior Publication Data

US 2025/0154756 A1 May 15, 2025

Related U.S. Application Data

(60) Provisional application No. 63/394,833, filed on Aug. 3, 2022.

(51) Int. Cl.
*E03D 9/08* (2006.01)
*A47K 13/00* (2006.01)

(52) U.S. Cl.
CPC ..... *E03D 9/08* (2013.01); *A47K 13/005* (2013.01)

(58) Field of Classification Search
CPC ..... A47K 13/005; E03D 9/08
USPC ..... 4/420.4, 420, 420.5, 447, 448
See application file for complete search history.

(56) References Cited

U.S. PATENT DOCUMENTS

| | | | |
|---|---|---|---|
| 3,808,608 | A | 5/1974 | Caplan |
| 3,916,453 | A | 11/1975 | Dominguez-Armada |
| 3,947,898 | A | 4/1976 | Durcharme |
| 4,069,520 | A | 1/1978 | Thomas |
| 4,145,767 | A | 3/1979 | Ibel |
| 4,237,560 | A | 12/1980 | Riegelman et al. |
| 5,090,067 | A | 2/1992 | Cogdill |
| 5,706,525 | A | 1/1998 | Olivier |
| 7,284,285 | B2 | 10/2007 | Scalzi |
| 7,316,038 | B2 | 1/2008 | Egeresi |
| 7,461,414 | B2 | 12/2008 | Santa Cruz et al. |
| 7,543,339 | B1 | 6/2009 | Harris |
| 8,060,953 | B1 | 11/2011 | Dorra |
| 8,261,377 | B2 | 9/2012 | Oh |
| 8,266,734 | B2 | 9/2012 | Allard et al. |
| 8,312,570 | B1 | 11/2012 | Chen |

(Continued)

*Primary Examiner* — Lori L Baker
(74) *Attorney, Agent, or Firm* — Schwartz Law Firm, P.C.

(57) ABSTRACT

A portable bidet assembly is adapted for use on a toilet bowl. The assembly includes a bidet housing designed for being located adjacent a rim of the toilet bowl, and having a fluid inlet and a fluid outlet. A supply hose connects a fluid source to the fluid inlet of the bidet housing, and a wash nozzle communicates with the fluid outlet of the bidet housing. A flow control valve is adapted for controlling a pressurized supply of fluid from the fluid source through the supply hose and bidet housing to the wash nozzle. First and second cooperating adjustable bowl clamp assemblies are designed for adjustably engaging the toilet bowl at opposite points below the rim, thereby releasably securing the bidet assembly to the toilet bowl.

12 Claims, 9 Drawing Sheets

(56) References Cited

U.S. PATENT DOCUMENTS

| | | | |
|---|---|---|---|
| 9,049,970 | B2 | 6/2015 | Dorra |
| 9,121,423 | B2 | 9/2015 | Sharpe et al. |
| 9,212,477 | B2 | 12/2015 | Tiagai |
| 9,637,903 | B2 | 5/2017 | Gupta |
| 10,076,215 | B1 | 9/2018 | Quay et al. |
| 10,267,026 | B2 | 4/2019 | Culton, Sr. |
| 10,272,544 | B1 | 4/2019 | Murray et al. |
| 10,844,586 | B2 | 11/2020 | Gupta |
| 10,980,707 | B2 | 4/2021 | Kong |
| 11,089,918 | B2 | 8/2021 | Nakamura |
| 11,326,332 | B2 | 5/2022 | Duprieu et al. |
| 11,505,934 | B2 | 11/2022 | Gupta |
| 11,542,699 | B2 | 1/2023 | Schrant et al. |
| 2005/0022292 | A1 | 2/2005 | Choi |
| 2005/0217015 | A1 | 10/2005 | Battistion et al. |
| 2006/0207007 | A1 | 9/2006 | Fogel |
| 2008/0155738 | A1 | 7/2008 | Uy |
| 2011/0252556 | A1 | 10/2011 | Park et al. |
| 2018/0028797 | A1 | 2/2018 | Schwab et al. |
| 2019/0161952 | A1 | 5/2019 | Muhi Deen et al. |
| 2019/0186115 | A1 | 6/2019 | Schwab et al. |
| 2021/0310226 | A1 | 10/2021 | Newcomb |
| 2023/0207942 | A1 | 6/2023 | Nam et al. |

RETROFIT PORTABLE BIDET ASSEMBLY

TECHNICAL FIELD AND BACKGROUND OF THE DISCLOSURE

The present disclosure relates broadly and generally to a retrofit portable bidet assembly-commonly referred to in the industry as a "travel bidet".

A travel bidet is a portable and compact device used for personal hygiene, particularly for cleansing oneself after using the toilet. It is designed to mimic the functionality of a traditional bidet, which is a fixture commonly found in bathrooms in many countries, especially in Europe and parts of Asia. Conventional travel bidets of the prior art typically consist of a small water reservoir, a nozzle or spout for spraying water, and a manual or battery-operated pump or squeeze mechanism to create the water pressure. The water spray helps to clean the area effectively, promoting better hygiene compared to using toilet paper alone. Advanced models might also incorporate additional features like adjustable spray intensity and nozzle angles.

Travel bidets are popular among those who are accustomed to bidet use and want to maintain their hygiene practices while on the go, especially in places where bidets may not be readily available or commonly used. They are also eco-friendly, as they reduce the reliance on toilet paper, which can be wasteful and harmful to the environment. The compact size and ease of use make travel bidets convenient for use during travel, camping trips, or in situations where traditional bidets are not present. Travel bidets may also be a suitable option for people who want to install a bidet on their toilet on a temporary basis.

For many currently available bidets, installation requires the user to remove the toilet seat and/or lid and to reconfigure existing plumbing. The bidet assembly of the present disclosure eliminates such requirements by enabling convenient retrofit installation which is fast, easy and non-invasive.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a portable bidet assembly adapted for use on a standard toilet bowl. In exemplary embodiments, the bidet assembly utilizes a standalone refillable fluid tank. The fluid tank may hold water or other cleansing solution. A bidet housing is adapted for being located adjacent a rim of the toilet bowl, and has a fluid inlet and a fluid outlet. A supply hose connects the fluid tank to the fluid inlet of the bidet housing, and a wash nozzle communicates with the fluid outlet of the bidet housing. A flow control valve is adapted for controlling a pressurized supply of fluid from the fluid tank through the supply hose and bidet housing to the wash nozzle. First and second cooperating adjustable bowl clamp assemblies are designed for adjustably engaging the toilet bowl at opposite points below the rim, thereby releasably securing the bidet assembly to the toilet bowl.

The term "tank" means any suitable rigid, semi-rigid or collapsible structure capable of holding a fluid under pressure.

According to another exemplary embodiment, each bowl clamp assembly incorporates a slidable C-block, a clamp pad carried by the slidable C-block, and a manual adjustment mechanism engaging the slidable C-block. The adjustment mechanism is operable for adjustably urging the clamp pad against an outside surface of the toilet bowl.

According to another exemplary embodiment, the assembly incorporates first and second clamp plates each defining an elongated travel slot forming a clamp track. The slidable C-block has a notched base received within the travel slot of the clamp plate, such that the slidable C-block is movable along the clamp track from one end of the travel slot to an opposite end of the travel slot. Each clamp plate may be separately formed, or one or both may be integrally formed together with the bidet housing.

According to another exemplary embodiment, the slidable C-block includes a body and spaced-apart top and bottom ears. The ears extend perpendicular to the body. The clamp pad and ears define aligned holes receiving a pivot pin, such that the pivot pin enables pivoting adjustment of the clamp pad upon engaging the outside surface of the toilet bowl.

According to another exemplary embodiment, the manual adjustment mechanism includes a threaded adjusting screw engaging the slidable C-block, a complementary-threaded fixed screw guide, and a hand knob. The fixed screw guide may have an internal screw thread or may carry a fixed (stationary) internally-threaded nut. The hand knob rotates the adjusting screw through the fixed screw guide, thereby moving the slidable C-block and clamp pad towards and away from the outside surface of the toilet bowl.

According to another exemplary embodiment, the clamp pad of each clamp assembly is fabricated of a material comprising rubber.

According to another exemplary embodiment, the flow control valve is a ball valve operatively located between the fluid inlet and the fluid outlet of the bidet housing.

According to another exemplary embodiment, a hand dial is located on top of the bidet housing and connects to the ball valve, such that rotation of the hand dial turns the ball valve to control a pressurized flow of fluid through the valve downstream to the wash nozzle.

According to another exemplary embodiment, an ergonomic seat is integrally molded with the bidet housing.

According to another exemplary embodiment, the bidet housing communicates with an internal flow channel formed by spaced-apart vertical channel walls extending continuously from the fluid outlet to the wash nozzle. As used in this context, the term "vertical" means perpendicular to the surface upon which the channel walls are formed.

According to another exemplary embodiment, the first and second clamp assemblies are located to reside on opposite sides of the rim and are designed to engage only outside surfaces of the toilet bowl. In this embodiment, no portion of the clamp assemblies covers the rim or extends inside the toilet bowl.

In yet another exemplary, the present disclosure comprises a method for securing a retrofit portable bidet assembly to a toilet bowl. The method includes lifting an existing seat (and lid, if applicable) of the toilet bowl to a raised position. A bidet housing of the bidet assembly is then placed adjacent a rim of the toilet bowl, such that a wash nozzle of bidet assembly projects downward inside the toilet bowl. A supply hose is then connected to a fluid inlet of the bidet housing and to a water source. Using first and second cooperating adjustable bowl clamp assemblies, the bidet assembly is releasably secured to the toilet bowl wherein no portion of the clamp assemblies covers the rim or extends inside the toilet bowl.

According to another exemplary embodiment, the method includes while in a seated position over the toilet bowl, disengaging the first and second bowl clamp assemblies thereby releasing the portable bidet assembly for removal.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
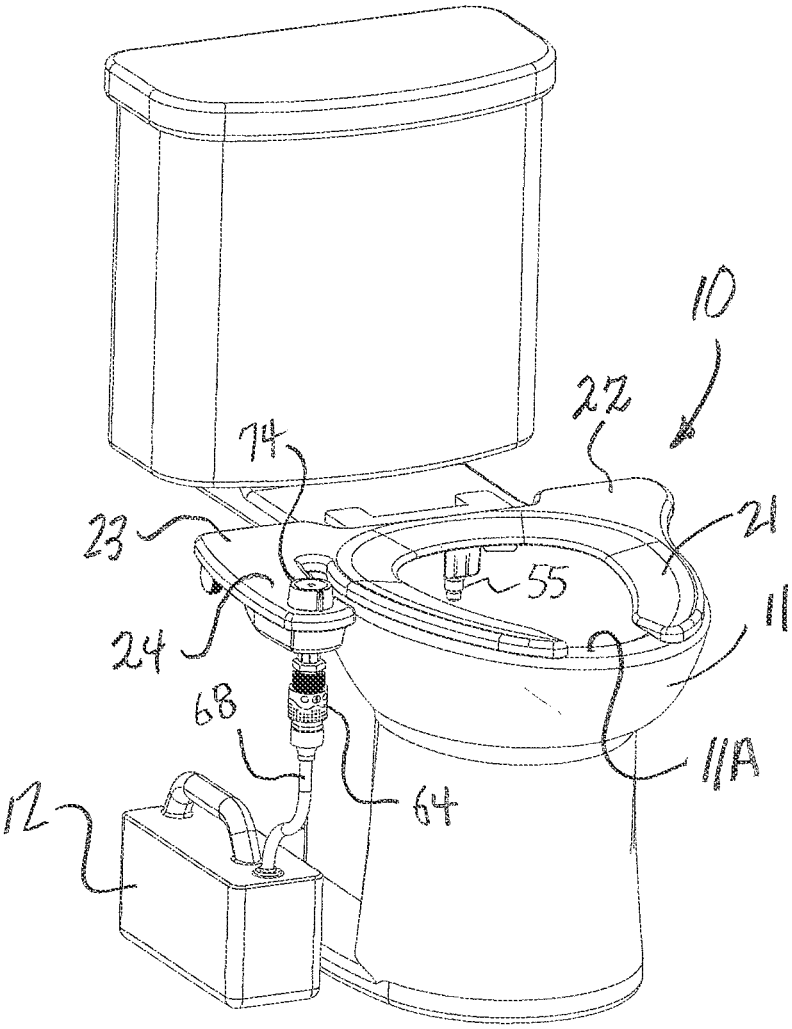
FIG. 1 is an environmental perspective view of a retrofit portable bidet assembly according to one exemplary embodiment of the present disclosure.

Referring now specifically to the drawings, a retrofit portable bidet assembly according to one exemplary embodiment of the present disclosure is illustrated in FIG. 1 and shown generally at broad reference numeral 10. The exemplary bidet assembly 10 is readily secured to a standard toilet bowl 11, as described below, without detaching or replacing existing components, such as the seat and/or lid (not shown), and without the need for special tools or hardware. In one embodiment, the bidet assembly 10 utilizes a stand-alone self-pressurizing 3.8-gallon water tank 12 with a built-in pump cap or other suitable mechanical or battery-powered pressurizing means. In alternative embodiments, the bidet assembly 10 connects directly to an existing water supply line adjacent the toilet.

As best illustrated in FIGS. 1-4, the present bidet assembly 10 comprises an ergonomically-shaped low-profile seat 21 configured to sit atop a rim 11A of the toilet bowl 11. The seat 21 is integrally-molded with opposing side shoulders 22, 23 and an elongated arm 24 extending forward of the right shoulder 23. Top and bottom parts 25, 26 of the rear seat 21, right shoulder 23 and right arm 24 are attached together by hardware 28 and cooperate to form a sealed bidet housing 30. The bottom part 26 of right shoulder 23 defines a first travel slot 34 forming a clamp track 35 for carrying a right side clamp assembly 40. A separate bottom plate 41 is attached by hardware 42 to the left shoulder 22 and defines a second travel slot 44 forming a clamp track 45 for carrying a left side clamp assembly 50. The right and left side clamp assemblies 40, 50 function to releasably secure the bidet assembly 10 to the toilet bowl 11, and their respective parts and adjustable operation are described further below with reference to FIGS. 5-8.

Figure 2:
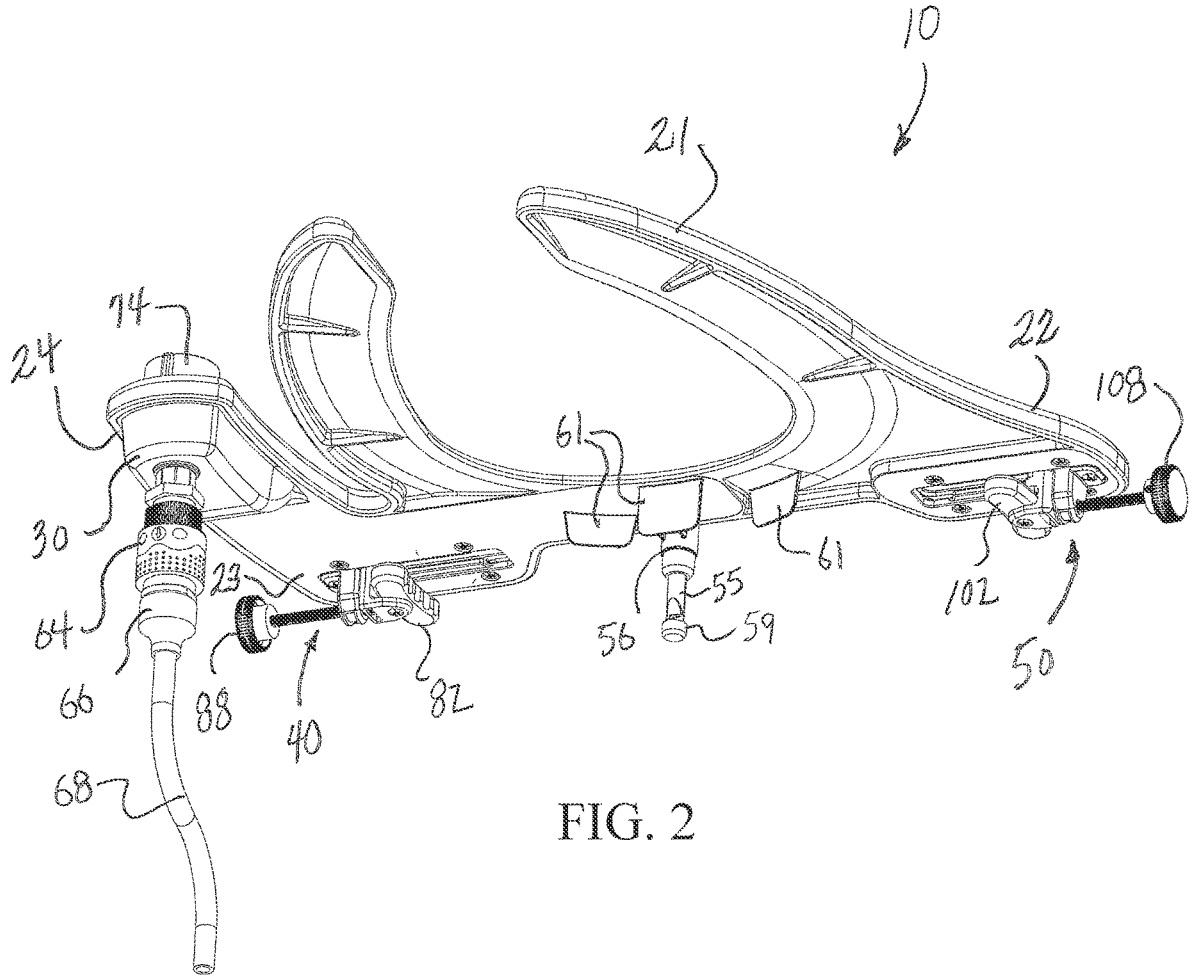
FIG. 2 is a further perspective view of the exemplary bidet assembly.
Figure 3:
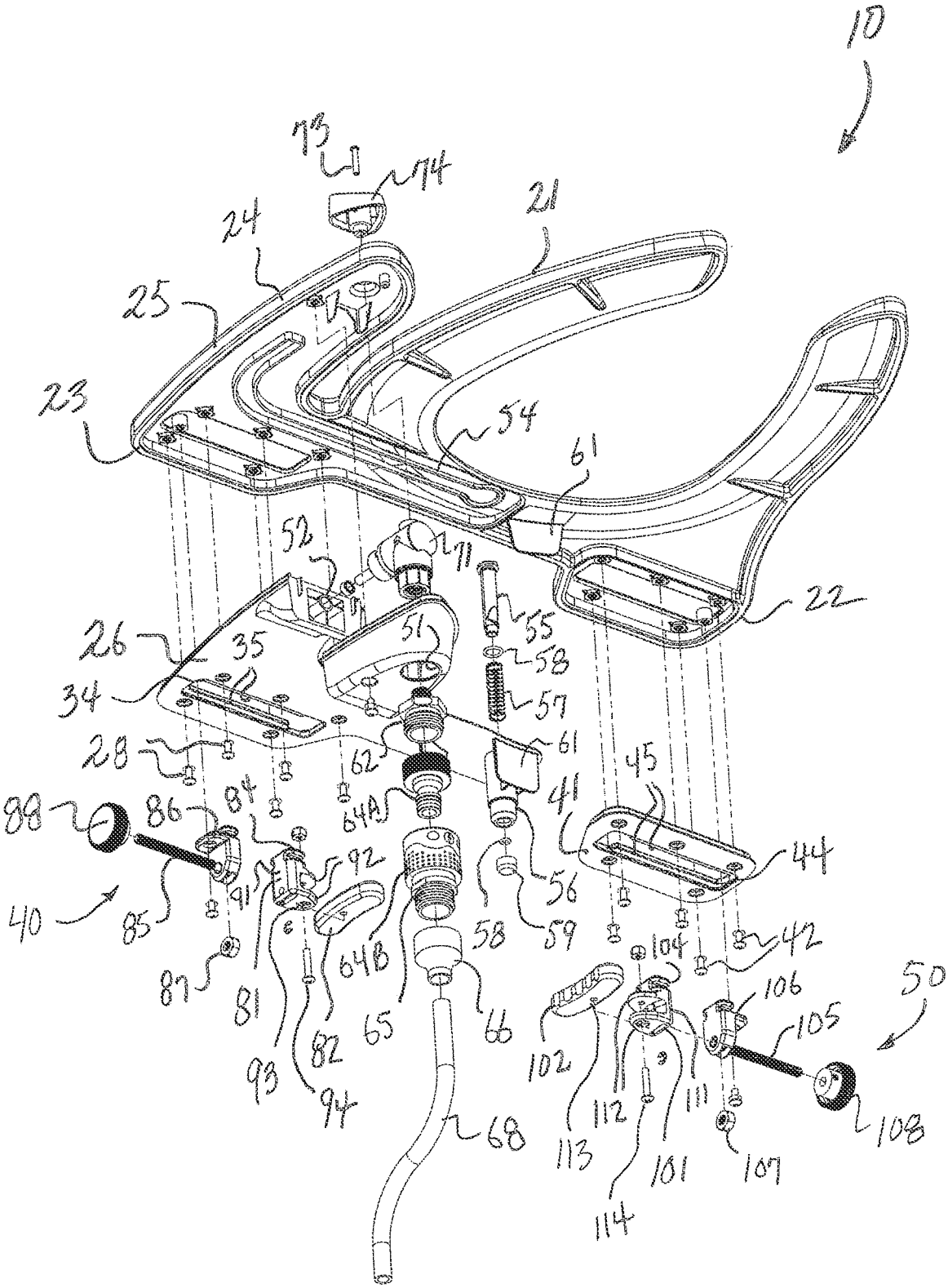
FIG. 3 is an exploded view of the exemplary bidet assembly.

Referring now to FIGS. 2 and 3, the bidet housing 30 located at the right arm 24 of assembly 10 resides adjacent (and outside) the rim 11A of the toilet bowl 11, and has a fluid inlet 51 and a fluid outlet 52. The fluid outlet 52 communicates with a sealed J-shaped flow channel 54 formed by spaced-apart internal channel walls extending continuously from the fluid outlet 52 to a retractable wash nozzle 55. The wash nozzle 55 operates in a conventional manner, extending through a fixed nozzle sheath 56 formed with the bottom part 26 and comprising a compression spring 57, O-rings 58 and a nozzle cap 59. Spaced apart spray shields 61 are formed adjacent the nozzle cap 59 to help control and direct water spray during operation of the bidet assembly 10.

Figure 4:
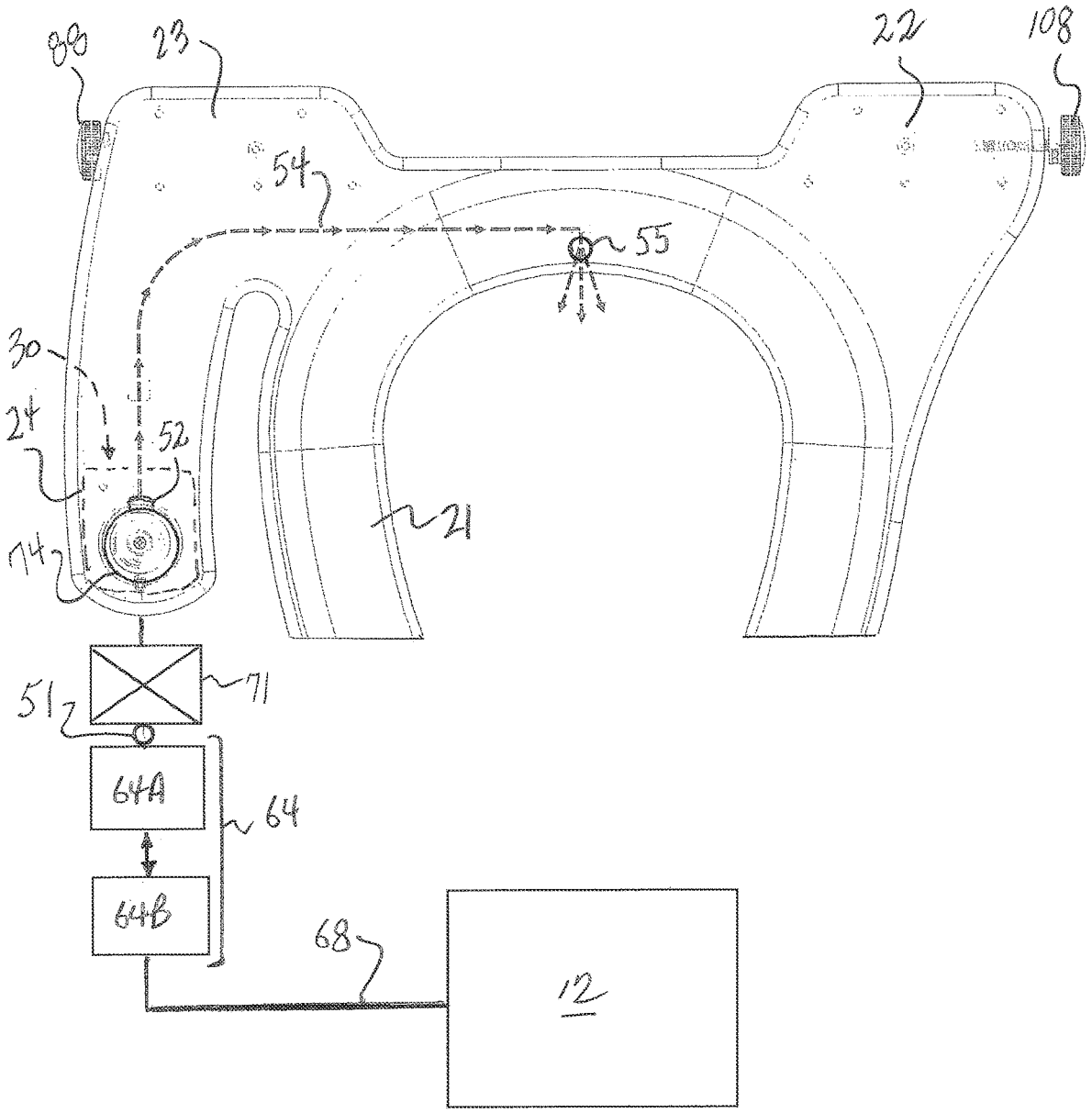
FIG. 4 is diagrammatic view of the exemplary bidet assembly demonstrating movement of water from the pressurized supply tank through the assembly housing to the wash nozzle.

As best shown in FIG. 3, the inlet 51 of bidet housing 30 is sealably connected to fitting 62 and a quick connect/disconnect coupling 64. The quick coupling 64 comprises male and female fittings 64A, 64B, and an externally-threaded end 65 which mates with a complementary-threaded hose connector 66. The hose connector 66 is located at the free of a flexible supply hose 68 extending from the pressurized water tank 12. In one exemplary embodiment, a flow control valve 71 is operatively arranged inside the housing 30 between the fluid inlet 51 and the fluid outlet 52, and connects via pin 73 to a hand dial 74 located atop the right arm 24 of assembly 10. Manual rotation of the hand dial 74 by the user turns the control valve 71 to selectively activate and adjust a pressurized flow of fluid through the valve 71. The control valve 71 may comprise a pivotable ball valve or other suitable valve or flow control means. FIG. 4 demonstrates movement of water from the pressurized water tank 12, through the flexible hose 68 and quick coupling 64, through the control valve 71 (as adjusted by hand dial 74) and outwardly from the housing 30 along the internal flow channel 54 to the wash nozzle 55.

Right Side and Left Side Adjustable Bowl Clamp Assemblies 40, 50

The exemplary clamp assemblies 40, 50 of the present bidet assembly 10 are best illustrated in FIGS. 5-9. The clamp assemblies 40, 50 function to adjustably engage respective outside surfaces of the toilet bowl 11 at opposite points below the rim 11A, and cooperate to releasably secure the bidet assembly 10 to the toilet bowl 11.

Figure 5:
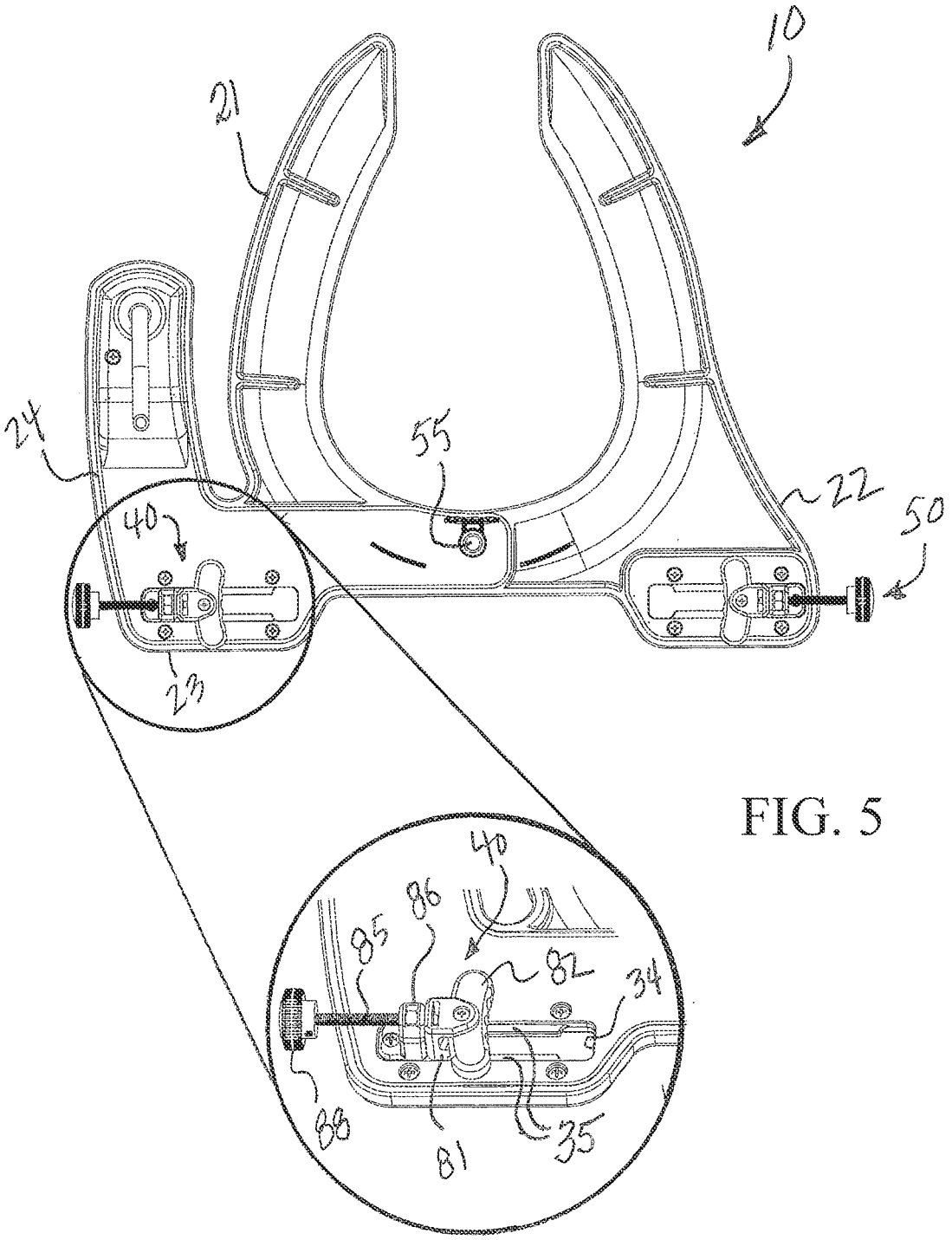
FIG. 5 shows an underside of the exemplary bidet assembly with the right shoulder isolated and enlarged.
Figure 7:
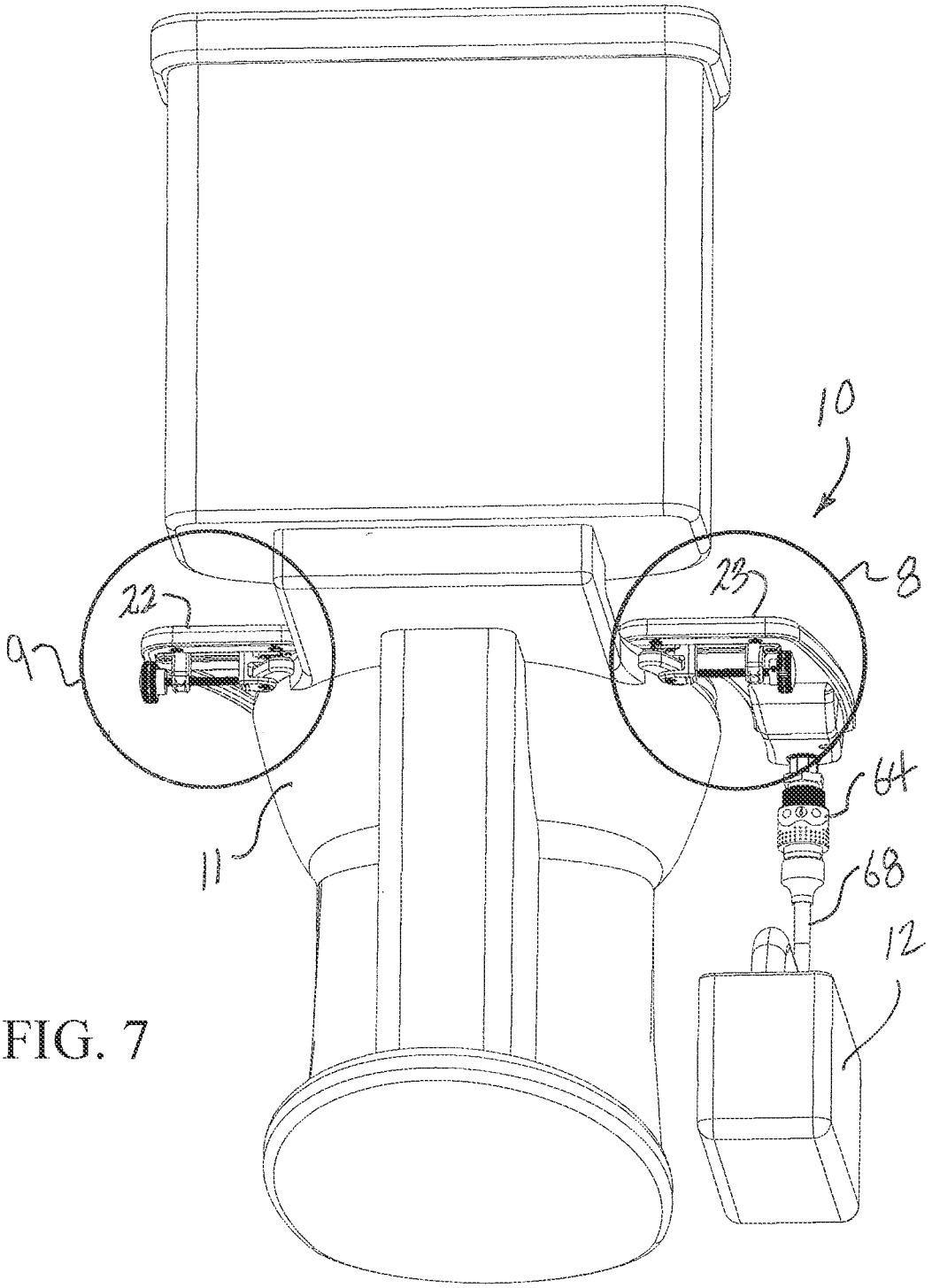
FIG. 7 is a rear perspective view showing the exemplary bidet assembly clamped to the toilet bowl.
Figure 8:
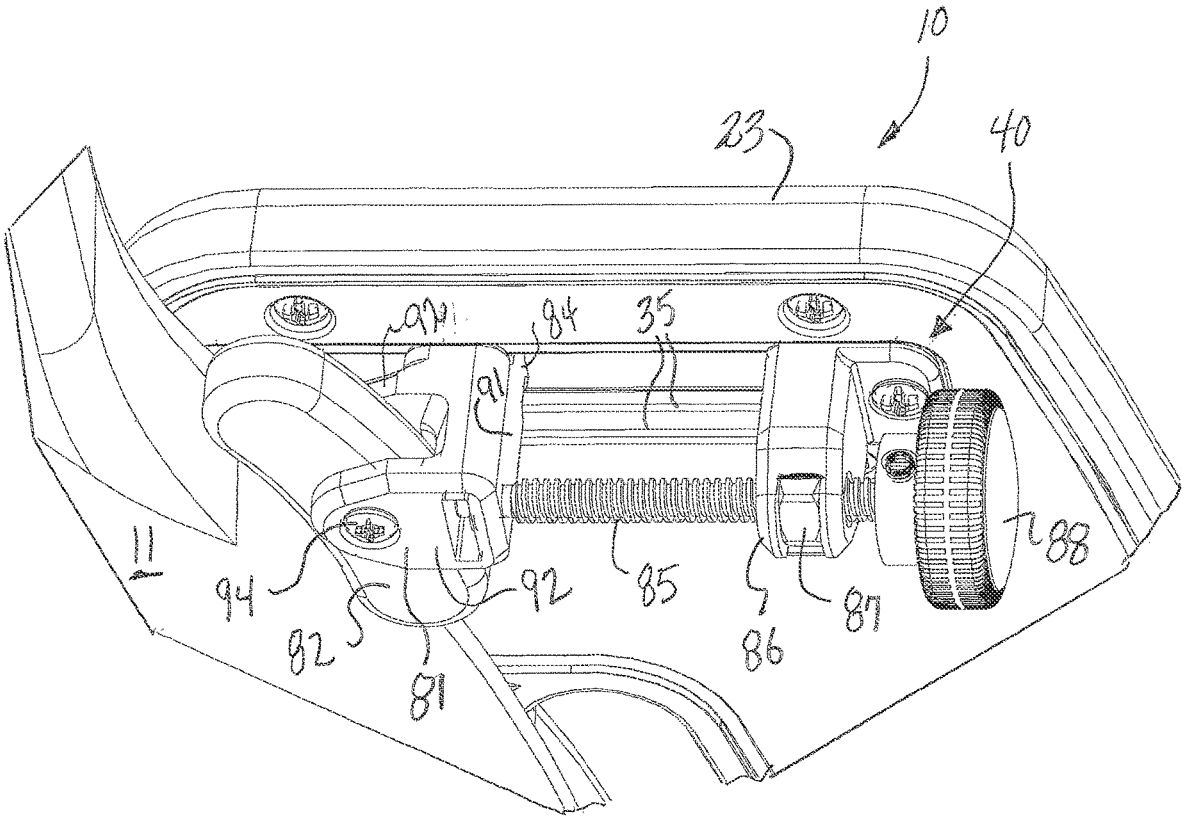
FIG. 8 is an enlarged view of the isolated portion indicated at reference number 8 of FIG. 7.

Referring to the right side shoulder 23 of assembly 10 shown in FIGS. 5, 7 and 8, the bowl clamp assembly 40 incorporates a slidable C-block 81, an arcuate clamp pad 82 carried by the slidable C-block 81, and a manual adjustment mechanism engaging the slidable C-block 81. The slidable C-block 81 has a notched base 84 received within the travel slot 34 at clamp track 35, such that the slidable C-block 81 is movable along the clamp track 35 from one end of the travel slot 34 to an opposite end of the travel slot 34. The manual adjustment mechanism includes a threaded adjusting screw 85 engaging the slidable C-block 81, a fixed screw guide 86 with complementary-threaded fixed nut 87, and a hand knob 88. The hand knob 88 rotates the adjusting screw 85 through the nut 87 of fixed screw guide 86, thereby moving the slidable C-block 81 and clamp pad 82 towards and away from the outside surface of the toilet bowl 11. In the exemplary embodiment shown, the slidable C-block 81 includes a body 91 and spaced-apart top and bottom ears 92. The ears 92 extend perpendicular to the body 91. The clamp pad 82 and ears 92 define aligned holes 93 receiving a pivot pin 94. The pivot pin 94 enables pivoting adjustment of the clamp pad 82 upon engaging the outside surface of the toilet bowl 11.

Figure 6:
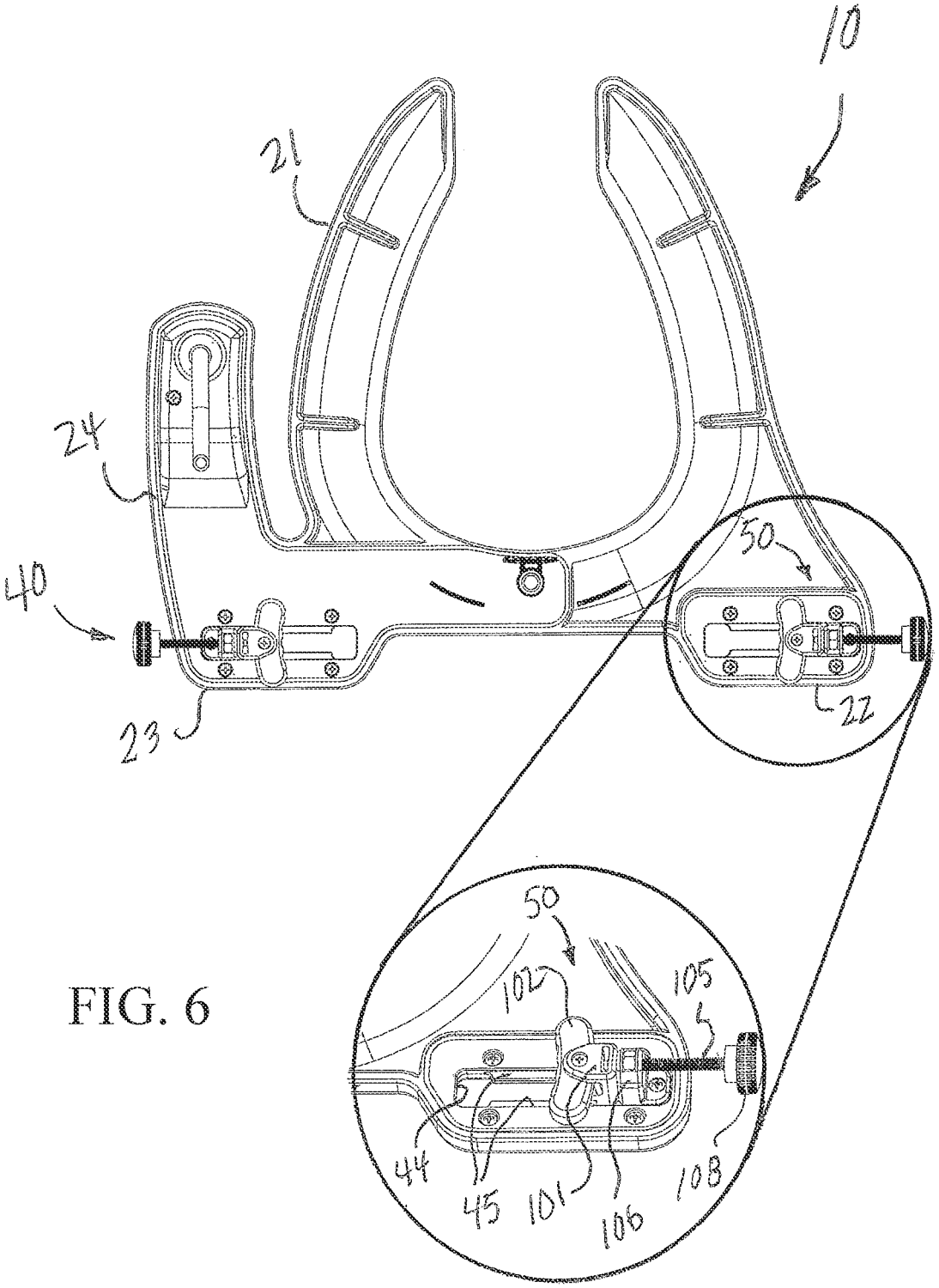
FIG. 6 shows an underside of the exemplary bidet assembly with the left shoulder isolated and enlarged.
Figure 9:
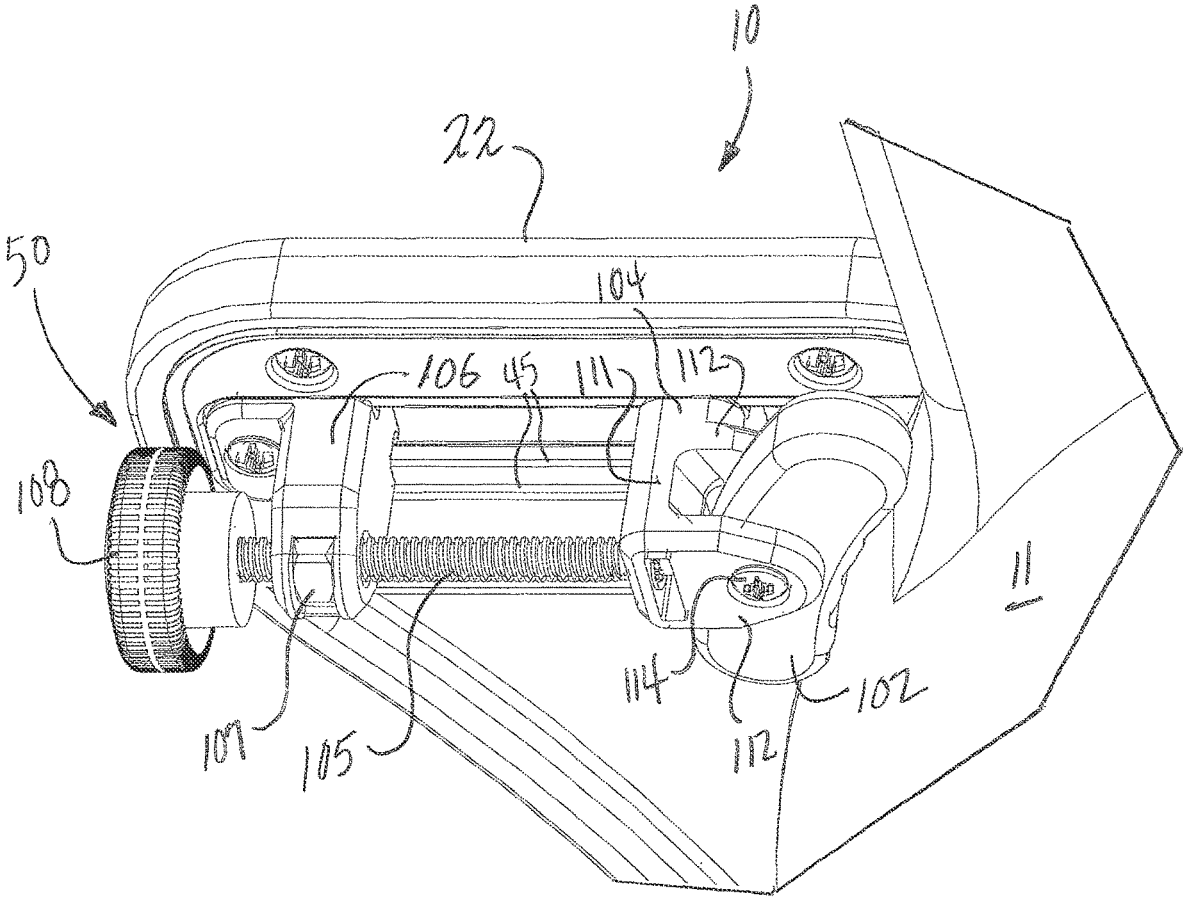
FIG. 9 is an enlarged view of the isolated portion indicated at reference number 9 of FIG. 7.

Referring to the left shoulder of assembly 10 shown in FIGS. 6, 7 and 9, like the right clamp assembly 40, the second assembly 50 incorporates a slidable C-block 101, an arcuate clamp pad 102 carried by the slidable C-block 101, and a manual adjustment mechanism engaging the slidable C-block 101. The slidable C-block 101 has a notched base 104 received within the travel slot 44 at clamp track 45, such that the slidable C-block 101 is movable along the clamp track 45 from one end of the travel slot 44 to an opposite end of the travel slot 44. The manual adjustment mechanism includes a threaded adjusting screw 105 engaging the slidable C-block 101, a fixed screw guide 106 with complementary-threaded fixed nut 107, and a hand knob 108. The hand knob 108 rotates the adjusting screw 105 through the stationary nut 107 of fixed screw guide 106, thereby moving the slidable C-block 101 and clamp pad 102 towards and away from the outside surface of the toilet bowl 11. In the exemplary embodiment shown, the slidable C-block 101 includes a body 111 and spaced-apart top and bottom ears 112. The ears 112 extend perpendicular to the body 111. The clamp pad 102 and ears 112 define aligned holes 113 receiving a pivot pin 114. The pivot pin 114 enables pivoting adjustment of the clamp pad 102 upon engaging the outside surface of the toilet bowl 11. In each of the clamp assemblies, the clamp pad 82, 102 may be fabricated of a material comprising rubber.

In an exemplary method of the disclosure, the present bidet assembly 10 is secured to the toilet bowl 11 by first lifting an existing seat (and lid, if applicable) of the toilet bowl to a raised position. The bidet housing 30 resides adjacent and outside the rim 11A of the toilet bowl 11, while the wash nozzle 55 projects downward inside the toilet bowl with the spray tip in a forward-facing orientation. The supply hose 68 interconnects the bidet housing 30 and water tank 12, as previously described. Using the first and second cooperating adjustable bowl clamp assemblies 40, 50, the bidet assembly 10 is releasably secured to the toilet bowl 11 such that no portion of the clamp assemblies 40, 50 covers the rim 11A or extends inside the toilet bowl 11. While in a seated position over the toilet bowl 11, the user can readily and conveniently utilize the hand knobs 88, 108 on opposite sides of the seat 21 to adjustably tighten the bidet assembly 10 onto the toilet bowl 11, and to release the bidet assembly 10 from the toilet bowl 11 for removal.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112 (f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A portable bidet assembly adapted for use on a toilet bowl, said bidet assembly comprising:

a standalone refillable fluid tank;

a bidet housing adapted for being located adjacent a rim of the toilet bowl, and comprising a fluid inlet and a fluid outlet;

a supply hose connecting said fluid tank to the fluid inlet of said bidet housing;

a wash nozzle communicating with the fluid outlet of said bidet housing;

a flow control valve adapted for controlling a pressurized supply of fluid from said fluid tank through said supply hose and bidet housing to said wash nozzle; and first and second cooperating adjustable bowl clamp assemblies designed for adjustably engaging the toilet bowl at opposite points below the rim to adjustably secure said portable bidet assembly to the toilet bowl, and wherein said first and second clamp assemblies are located to reside on opposite sides of the rim and are designed to engage only outside surfaces of the toilet bowl, such that no portion of said clamp assemblies covers the rim or extends inside the toilet bowl.

2. The portable bidet assembly according to claim 1, wherein each bowl clamp assembly comprises a slidable C-block, a clamp pad carried by said slidable C-block, and a manual adjustment mechanism engaging said slidable C-block and operable for adjustably urging said clamp pad against an outside surface of the toilet bowl.

3. The portable bidet assembly according to claim 2, and comprising first and second clamp plates each defining an elongated travel slot forming a clamp track, and wherein said slidable C-block has a notched base received within said clamp track such that said slidable C-block is movable along said clamp track from one end of said travel slot to an opposite end of said travel slot.

4. The portable bidet assembly according to claim 3, wherein said slidable C-block comprises a body and spaced-apart top and bottom ears, and wherein said clamp pad and ears define aligned holes receiving a pivot pin, such that said pivot pin enables pivoting adjustment of said clamp pad upon engaging the outside surface of the toilet bowl.

5. The portable bidet assembly according to claim 4, wherein said manual adjustment mechanism comprises a threaded adjusting screw engaging said slidable C-block, a complementary-threaded fixed screw guide, and a hand knob for rotating said adjusting screw through said fixed screw guide, thereby moving said slidable C-block and clamp pad towards and away from the outside surface of the toilet bowl.

6. The portable bidet assembly according to claim 5, wherein said clamp pad of each clamp assembly is fabricated of a material comprising rubber.

7. The portable bidet assembly according to claim 1, wherein said flow control valve comprises a ball valve operatively located between the fluid inlet and the fluid outlet of said bidet housing.

8. The portable bidet assembly according to claim 7, and comprising a hand dial located on top of said bidet housing and connected to said ball valve, such that rotation of said hand dial turns said ball valve to control a pressurized flow of fluid through said valve.

9. The portable bidet assembly according to claim 1, and comprising an ergonomic seat integrally molded with said bidet housing.

10. The portable bidet assembly according to claim 1, wherein said bidet housing communicates with an internal flow channel formed by spaced-apart vertical channel walls extending continuously between the fluid inlet and fluid outlet to said wash nozzle.

11. A method for securing a retrofit portable bidet assembly to a toilet bowl, said method comprising:

lifting an existing seat of the toilet bowl to a raised position;

locating a bidet housing of the bidet assembly adjacent a rim of the toilet bowl, such that a wash nozzle of bidet assembly projects downward inside the toilet bowl;

connecting a supply hose to a fluid inlet of the bidet housing and to a water source;

using first and second cooperating adjustable bowl clamp assemblies, releasably securing the bidet assembly to the toilet bowl wherein no portion of the clamp assemblies covers the rim or extends inside the toilet bowl.

12. The method according to claim 11, and comprising while in a seated position over the toilet bowl, disengaging the first and second bowl clamp assemblies thereby releasing the portable bidet assembly for removal.

* * * * *